US007841912B2

(12) United States Patent
Hachadorian

(10) Patent No.: US 7,841,912 B2
(45) Date of Patent: Nov. 30, 2010

(54) SOCKET FOR AN ELECTRICAL PLUG AND SOCKET CONNECTION

(75) Inventor: Gary Hachadorian, Roellbach (DE)

(73) Assignee: Erich Jaeger GmbH & Co. KG, Friedberg (DE)

( * ) Notice: Subject to any disclaimer, the term of this patent is extended or adjusted under 35 U.S.C. 154(b) by 60 days.

(21) Appl. No.: 12/046,839

(22) Filed: Mar. 12, 2008

(65) Prior Publication Data

US 2009/0142971 A1 Jun. 4, 2009

(51) Int. Cl.
*H01R 13/405* (2006.01)

(52) U.S. Cl. ..... 439/736

(58) Field of Classification Search ..... 439/142, 439/35, 206, 651, 34, 676
See application file for complete search history.

(56) References Cited

U.S. PATENT DOCUMENTS

| | | | | |
|---|---|---|---|---|
| 2,229,211 | A | | 1/1941 | Korengold |
| 3,522,575 | A | | 8/1970 | Johnson et al. |
| 4,952,169 | A | | 8/1990 | Hayes, Sr. |
| 5,085,595 | A | | 2/1992 | Koegel et al. |
| 5,087,212 | A | | 2/1992 | Hanami |
| 5,354,204 | A | * | 10/1994 | Hughes ..... 439/35 |
| 5,492,485 | A | | 2/1996 | Drewanz et al. |
| 5,518,427 | A | | 5/1996 | Kan et al. |
| 5,749,743 | A | | 5/1998 | Harada et al. |
| 5,800,188 | A | | 9/1998 | Barber et al. |
| 5,873,752 | A | | 2/1999 | Baskin et al. |
| 6,086,422 | A | | 7/2000 | Glynn |
| 6,315,611 | B1 | | 11/2001 | Sawada et al. |
| 6,764,351 | B2 | | 7/2004 | Finzer et al. |
| 6,793,533 | B2 | | 9/2004 | Berg et al. |
| 7,081,012 | B2 | | 7/2006 | Gensert et al. |
| 7,241,181 | B2 | * | 7/2007 | Machado et al. ..... 439/676 |

* cited by examiner

*Primary Examiner*—Briggitte R Hammond
(74) *Attorney, Agent, or Firm*—McAndrews, Held & Malloy, Ltd.

(57) ABSTRACT

A socket for an electrical plug and socket connection is described, comprising a socket housing with a plug-in opening for mounting a plug. The plug-in opening includes a contact support component for mating with a plug which provides contacts extending into the plug-in opening. The contacts are preferably flat contacts with an elastically bent contact surface. Also preferably, the contacts are cast in an injection molding process into the contact support insert. The contact support insert is then incorporated into the plug-in opening of the socket housing, and a seal is provided between the two components.

16 Claims, 3 Drawing Sheets

SOCKET FOR AN ELECTRICAL PLUG AND SOCKET CONNECTION

BACKGROUND OF THE INVENTION

The present technology relates to a socket for an electrical plug and socket connection, comprising a socket housing with a plug-in opening. The plug-in opening includes a contact support component for mating with a plug, wherein the contact support provides contacts extending into the plug-in opening. The contacts are preferably flat contacts with an elastically bent contact surface.

A previous type of socket is disclosed in U.S. Pat. No. 5,873,752, which describes an electrical connection for a trailer pulled by a vehicle. That patent discloses a unitary socket and contact insert, wherein the contact insert contains flat contacts with elastically bent contact surfaces that are inserted in corresponding openings of the contact support insert. To seal the socket, after the contacts are inserted, the plug-in openings are sealed with a liquid sealant. This method unnecessarily complicates production. Additionally, such sealants are typically not weather resistant. The use of such sealants is therefore undesirable in vehicle applications.

SUMMARY OF THE INVENTION

One object of the present technology, therefore, is to provide a reliably sealed socket that can be simply produced, which permits permanent and reliable sealing of the contacts extending from a contact insert.

The present technology task aims to achieve this objective by providing contacts that are preferably cast in an injection molding process into the contact support insert. The contact support insert is then incorporated into the plug-in opening of the socket housing, and a seal is provided between the two components. In contrast to prior sockets, the socket and contact support insert of the present technology, therefore, are no longer produced as a unitary component in a single manufacturing process. Instead, the contact support insert is preferably produced with the contacts fixed in it, and subsequently sealed into the socket housing. For design reasons, because flat contacts with an elastically bent contact surface are used, it is not possible to cast them directly into a socket housing. U.S. Pat. No. 5,873,752 discloses such an example, in which the elastically bent contact surfaces are produced within a plug-in opening of the socket housing. In that type of arrangement, the injection molding die for the socket cannot be removed.

On the other hand, it is possible, to provide a contact support insert according to the present technology, with cast-in flat contacts, since the injection molding die can be pulled to the side from the contact support insert, and is not locked behind the elastically bent contacts. Compared to sealing each individual contact, just sealing the contact support insert into the socket housing is much simpler. Consequently, the presently disclosed socket can be produced more effectively at a low cost.

According to one preferred embodiment of the presently disclosed socket, the contacts protrude from the plug-in side of the contact support insert, which is set in the plug-in opening. The surfaces of at least one part of the contacts are preferably bent outward, i.e., away from the center of the contact support insert. Between the bent end of the contact surface and the mounting end of the contact surface, a gap remains, which serves as an application point for the die gates during injection molding. The gap also preferably presses the contacts against a core arranged in the center of the contact insert, for fastening the contacts. The contacts (preferably flat contacts with elastically bent contact surfaces) are preferably arranged near the edge of the contact support insert, for example, in a circle around the center of the contact support insert.

Between these preferably circularly arranged contacts, protrusions that extend from the mounting side of the contact support insert can be provided, which serve to stabilize the contacts or injection molding dies during the injection molding process.

To allow the contact support insert to be inserted into the socket housing, the socket housing preferably comprises a step at the end of the plug-in opening, on which the contact support insert (with an optional seal) may be positioned. This arrangement permits the forces that occur during insertion of the plug into the plug-in opening to be reliably dealt with.

A seal is also preferably positioned in the socket housing, wherein the seal has a first sealing surface arranged in the plug-in opening for cooperation with the plug. The first sealing surface can preferably be moved in the plug-in direction of the socket housing. It is believed that this type of configuration provides good sealing of the contact space between the plug and socket.

The seal can also form a second sealing surface with the socket housing. Preferably, this second sealing surface is provided at the inside peripheral surface of the plug-in opening adjacent to the contact support insert. It is believed that this type of arrangement provides good sealing of the interior of the socket housing, even in the absence of a plug.

In order for the first sealing surface of the seal to provide sufficient sealing pressure against the housing of the inserted plug, and also to provide sealing even when different plugs with different dimensions are used, it is particularly preferable to provide a first sealing surface that can be adjusted in the plug-in direction of the socket via an elastic force. This type of configuration results in the seal, with its first sealing surface, defining the end position of a plug inserted into the socket, where the plug abuts the seal. This feature can be provided even when different plugs are used, having different dimensions, or when a plug is not completely inserted into the socket. When the sealing surface of the seal moves against an elastic force, the force between the two sealing surfaces can compensate to achieve good sealing.

According to a particularly preferred embodiment, the seal has an elastically deformable section for generation of the elastic force, which is distinct from the first sealing surface. This elastically deformable section preferably lies between the first sealing surface and second sealing surface (the surface for sealing between the contact insert and the socket housing). Preferably, the elastically deformable section(s) of the seal are provided adjacent to the sealing surfaces. Because the elastically deformable section is arranged separate from the first, and optionally second and third sealing surfaces, deformation of the seal, therefore, will have no negative effect on sealing properties of the sealing surfaces.

In one variation, the elastically deformable section can have at least two preferably V-shaped extensions, which are adjustable in a bellows-like fashion. By changing the angle between the V-shaped extensions during adjustment or shifting of the sealing surface, an elastic force is generated.

Alternatively, or in addition, the seal can have a separate spring element in the elastically deformable section. This type of configuration has the advantage of allowing the applied sealing force to be specifically adjusted. This separate spring element is preferably integrated into the seal and provided, for example, as a coil spring that supports the sealing surface. In addition, V-shaped, preformed leaf springs, distributed on the peripheral edge of the seal, can also be provided as spring elements. These leaf springs can add to the elastic effect of adjusting the angle of the V-shaped extensions in the seal. The spring element can be made from metallic or non-metallic material and be fully enclosed by the rubber-elastic material of the seal.

In order to achieve a reliable seal with the surface of the plug inserted into the plug-in opening, the first sealing surface is preferably aligned essentially perpendicular to the inner peripheral surface of the plug-in opening. It can also lie laterally against this peripheral surface, so that the seal, during adjustment, is guided through the internal peripheral surface of the plug-in opening.

According to a particularly preferred embodiment of the technology, the seal is arranged, at least in sections, around the contact support insert, to achieve a seal between the contact support insert and socket housing. This type of configuration aligns the seal relative to the contact support insert and socket housing.

In another embodiment, the seal can also form a third sealing surface with the contact support insert, in order to also seal the socket interior from moisture that may penetrate into the contact area of the plug-in opening.

In order to be able to easily mount the seal and simultaneously achieve a good sealing effect on the first, second and/or third sealing surface, the seal is preferably designed as a single component made of a rubber-elastic material.

In order to secure the seal between the socket housing and the contact support insert, the interior of the socket housing can also preferably include a step with a protrusion extending into the plug-in opening of the socket, wherein the protrusion mates with a corresponding groove/recess in the seal. The protrusion can run along the entire step in the socket housing or can be arranged in sections.

In order to secure the contact support insert into the socket housing, the contact support insert can preferably connect via a locking mechanism in the socket housing. For example, a snap-in clip can be provided on the contact support insert, which mates with a corresponding snap-in clip on the socket housing. The locking mechanism is preferably arranged in a positioning area provided between the plug-in opening and the contact opening situated on the opposite side of the socket. Other types of locking mechanisms suitable for purposes of this technology may also be used.

Additionally, instead of locking the contact support insert in the socket housing, the contact support insert can also be welded or glued into the socket. In that type of configuration, there is no need for a seal arranged between the contact support insert and the socket housing, since, by welding or gluing, the socket housing is sufficiently sealed. Therefore, only one seal would be provided relative to the plug being inserted into the socket, which can be configured, for example, similar to the seal just described and, in particular, be adjustable against an elastic force in the plug-in direction of the socket.

Yet another possibility of fastening the contact support insert into the socket involves molding the socket housing around the contact support insert in a second injection molding process. This method is also feasible with corresponding injection molding dies and represents a good possibility for cost-effective production of the presently described socket.

BRIEF DESCRIPTION OF THE DRAWINGS

Additional features, advantages and application possibilities of the present invention are also apparent from the following exemplary drawings. All described and/or pictured features, alone or in any combination, illustrate exemplary embodiments of the present invention independently of their summary in the claims and/or specification.

In the drawings.

DETAILED DESCRIPTION OF THE INVENTION

Figure 1:
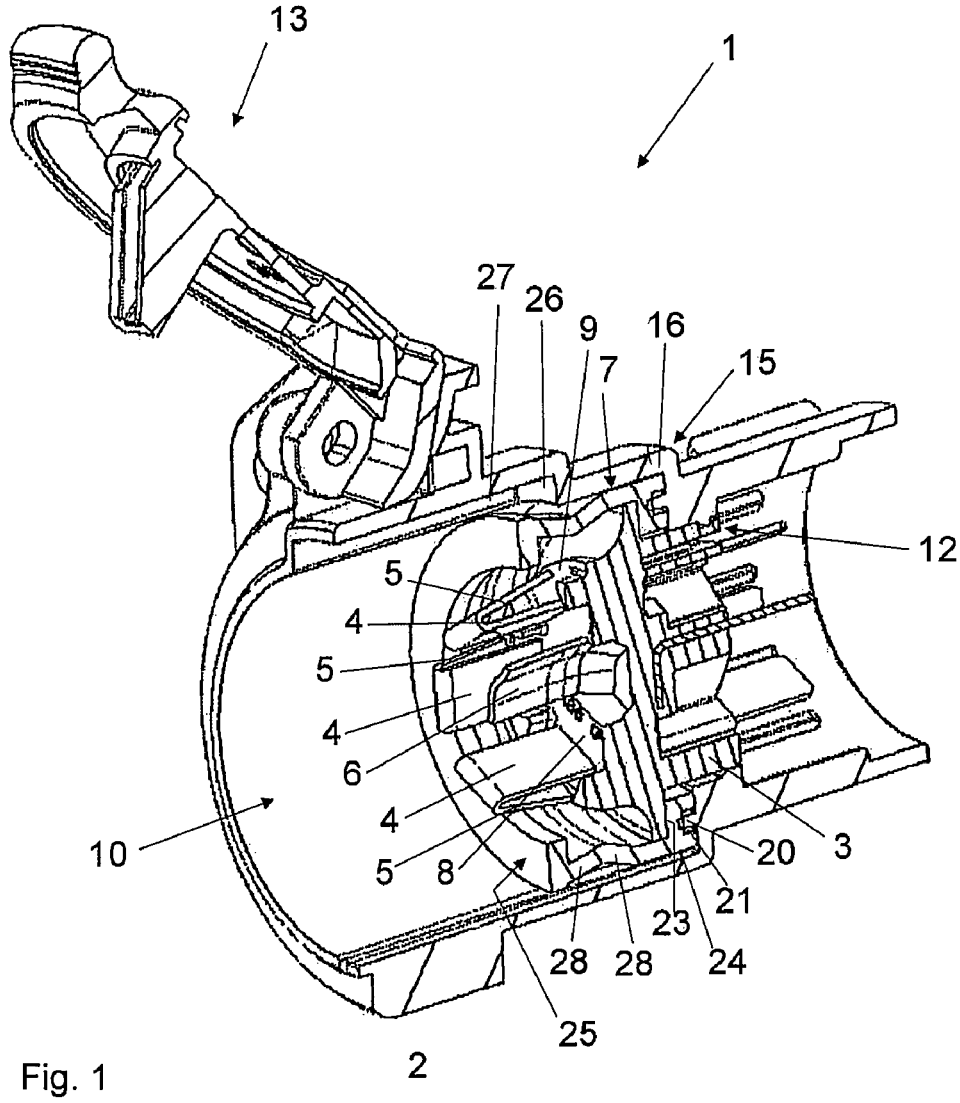
FIG. 1 illustrates a three-dimensional sectional drawing of the socket according to the invention.

FIG. 1, one of the preferred embodiments of the present technology, illustrates a socket 1 for an electrical plug and socket connection, which includes a socket housing 2 containing a contact support insert 3 with contacts 4. The contacts are preferably provided as flat contacts with elastically bent contact surfaces 5, wherein the contact surfaces are bent outward in relation to the center of the contact support insert, i.e., toward the edge of the contact support insert. A center contact 6 is preferably arranged in the center of the contact support insert 3, which has no bent contact surface.

Figure 3:
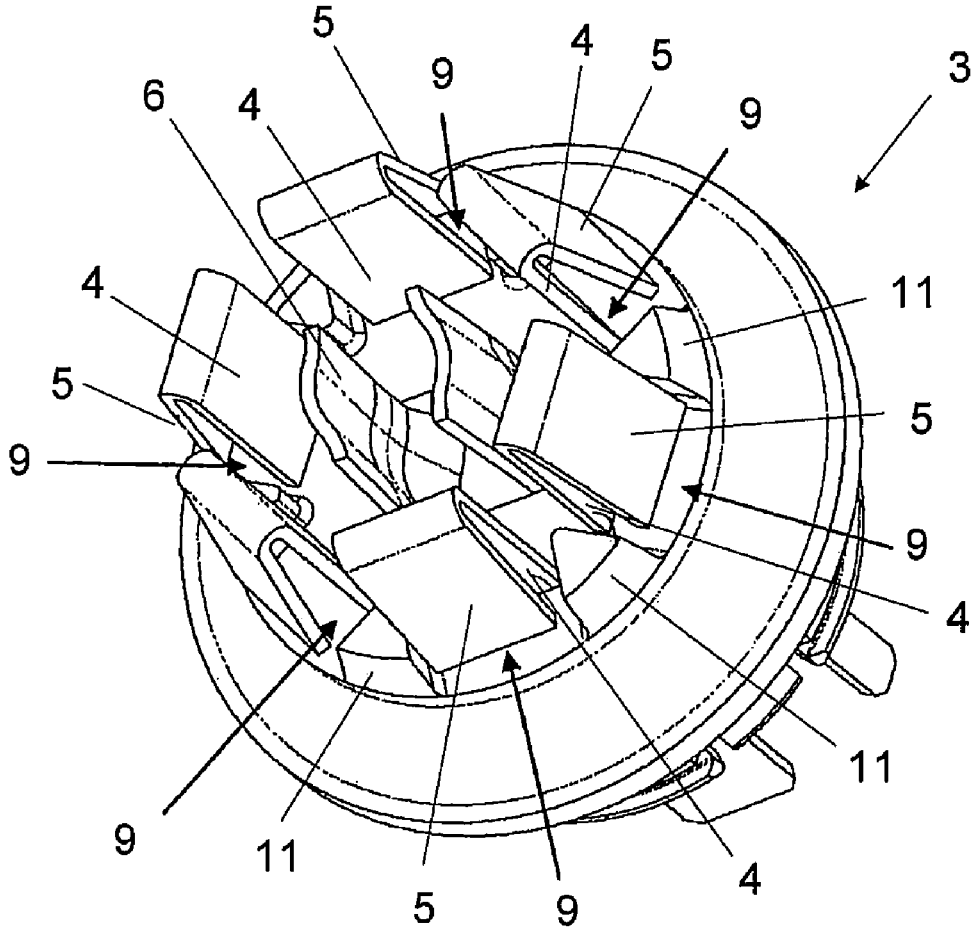
FIG. 3 illustrates a three-dimensional view of the contact insert with flat contacts.

The contacts 4, 6 are preferably cast in an injection molding process into the contact support insert 3. The contact support insert 3 is then incorporated in the housing 2 of the socket 1 with sealing of the plug-in opening 10 by means of a seal 7. The contacts 4, 6 preferably protrude from the mounting side 8 of the contact support insert 3 arranged in the plug-in opening, and the bent contact surfaces 5 of the contacts 4 are bent outward so that a gap 9 is formed between the end of the bent contact surface 5 and the mounting side 8. This gap 9 is also illustrated in FIG. 3, which provides an enlarged view of the contact support insert 3. This gap 9 also presses the opposing contact surfaces 4 and 5 towards each other, and prevents the contact surfaces 5 from lying against the mounting surface 8.

The gap 9 also aids production of the contact support insert 3 with the cast-in contacts 4, 6. In the injection molding process, a negative mold of the contact support insert is preferably produced that is then injected. Due to the shape of the contacts 4 with outwardly bent contact surfaces 5, it is therefore preferable to provide gates in the injection mold that are pushed into the gap 9, and after injection molding, can be pulled radially outward. This configuration typically means that the contacts 4 cannot be injection molded into the interior of the socket housing 2 (i.e., the plug-in opening 10 shown in FIG. 1), because the gates of the injection mold pushed into gap 9 can no longer be simply removed from the plug-in opening 10. In order to avoid this, the contact support insert 3 (with injection molded contacts 4) is preferably produced in a first production step, and the finished contact support insert 3 is then inserted into the plug-in opening 10 of the socket 1 in sealed fashion.

As shown in FIG. 3, triangular-shaped, inward-tapering protrusions 11 may also be provided between the contacts 4, near the outer edge of the contact support insert 3, which serve to stabilize the contact support insert 3 and the injection molding die.

Figure 2:
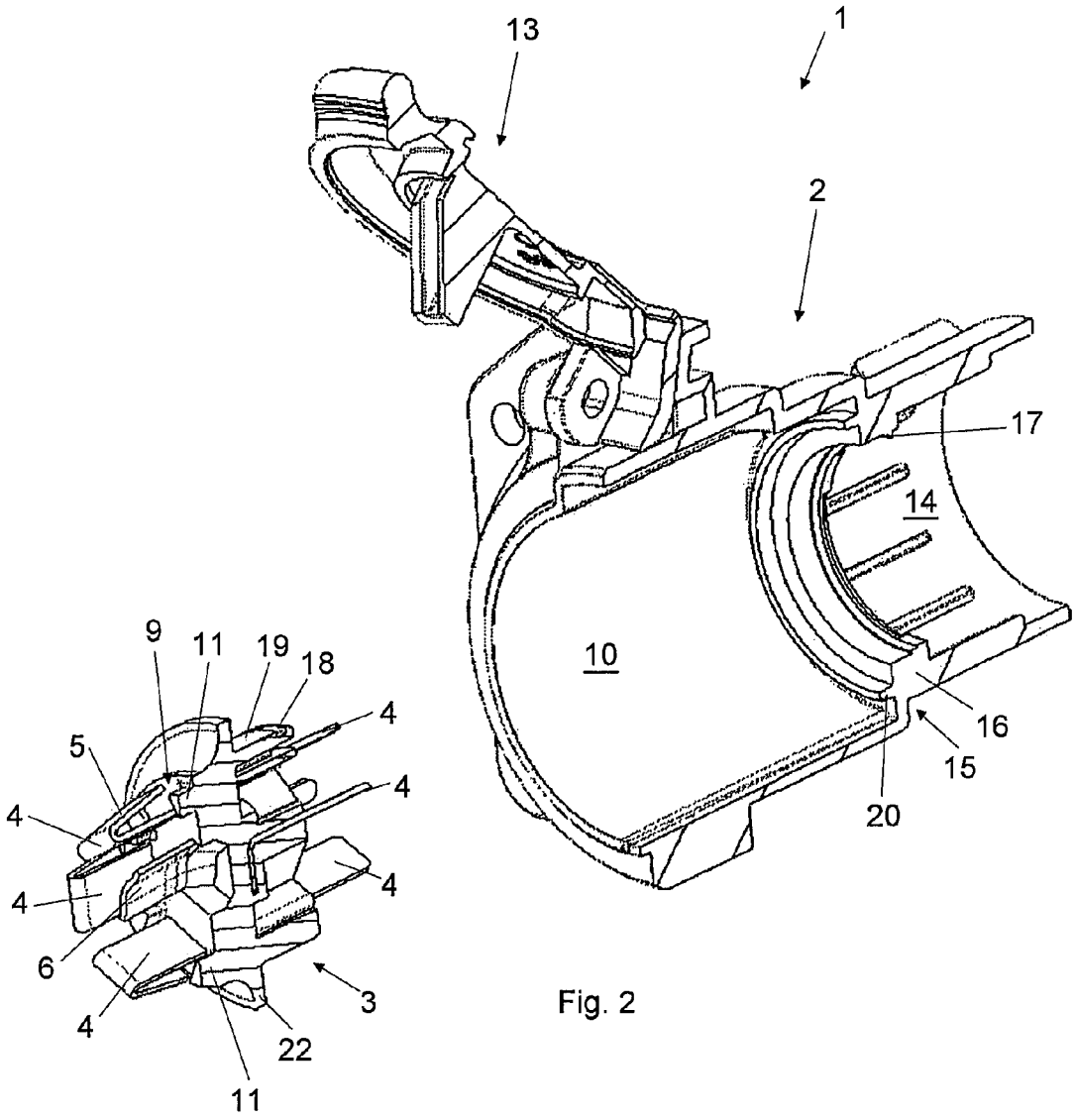
FIG. 2 illustrates a three-dimensional cross-section of the socket housing and the contact insert in an exploded view.

As shown in FIG. 2, a locking mechanism 12 may also be provided to fasten the contact support insert 3 into the housing 2 of the socket 1. FIG. 2 provides an exploded view of a preferred embodiment of the housing 2 of the socket 1 and contact support insert 3.

Additionally, as shown in FIG. 2, the plug-in opening 10 of housing 2 can also preferably be closed by a cover 13. Also, on the opposite (rear) side of socket, a contact opening 14 can be provided, wherein a plug (not shown) can be mounted, on the rear contacts 4 of the contact support insert 3 positioned in housing 2. Between the plug-in opening 10 and the contact opening 14 (which both have different inside diameters), a step 15 with a reinforced area 16 may be formed, on which the contact support insert 3 may be fastened. The reinforced housing area 16 preferably steps inward to provide a narrower opening than the plug-in opening 10 or the contact opening 14. In this narrower opening area, a snap-in clip 17 may be provided, which mates with a snap-in clip 18 in a bracket 19 of the contact support insert 3. When the contact support insert 3 is pushed into the plug-in opening 10, locking may be achieved between the snap-in clip 17 and snap-in clip 18, as shown in FIG. 1.

Also as shown in FIG. 2, the step 15 in the housing 2 can be provided with a fastening protrusion 20, which runs along the step 15. As shown by FIG. 1, this fastening protrusion 20 preferably mates with the seal 7, via a recess or groove 21 that corresponds to the fastening protrusion 20. The fastening protrusion 20 also presses the seal 7 firmly against a flange-like section 22 of the contact support insert 3, so that the contact support insert 3 is reliably sealed in relation to seal 7 at this point by a third sealing surface 23. Compression of the seal 7 near the groove 21 through mating of the groove 21 with the fastening protrusion 20 causes the seal 7 to form a second sealing surface 24, which is perpendicular to the third sealing surface 23, and which cooperates with the inside wall of the plug-in opening 10. In addition, the seal 7 also preferably forms a first seal surface 25 in the plug-in opening 10, which is aligned essentially perpendicular to the inner peripheral surface of the plug-in opening 10, and which lies laterally against this peripheral surface. A sealing surface on the end of a plug (not shown), will therefore abut the first sealing surface 25, and seal the space between the contacts 4, 6 and the plug.

Such a plug can preferably then be pushed into the plug-in opening 10 of the socket 1 to, at most, an end position 26 on the end of a coding groove 27. Before reaching this end position 26, however, a sealing surface on the end of the plug will meet the first sealing surface 25 of seal 7. Further advancing the plug into the plug-in opening 10 will then compress V-shaped extensions 28 of an elastically deformable section of the seal 7, and the resulting elastic force will press the first sealing surface 25 of the seal 7 towards the contact support insert 3. Through deformation of the V-shaped extensions 28, an elastic force in seal 7 will adjust the first sealing surface 25 in the plug-in direction of the plug. Because of this elastic force, a pressure may be achieved between the sealing surface 25 of the seal 7 and the sealing surface of the plug, so that the contact between them is thus sealed.

In short, the present technology encompasses a socket 1, reliably sealed against penetration of moisture, which can be produced simply in an injection molding process, despite having flat contacts in the plug-in opening 10, by producing a contact support insert 3 with contacts 4, 6 in a first injection mold, and then sealing that contact insert 3 into the socket 1.

LIST OF REFERENCE NUMBERS

1 Socket
2 Housing
3 Contact support insert
4 Contacts
5 Contact surface
6 Center contact
7 Seal
8 Mounting side
9 Gap
10 Plug-in opening
11 Triangular-shaped, inward-tapering protrusions
12 Locking mechanism
13 Cover
14 Contact opening
15 Step
16 Reinforced housing area
17 Snap-in clip
18 Snap-in clip
19 Snap-in bracket
20 Fastening protrusion
21 Groove/recess
22 Flange-like section
23 Third sealing surface
24 Second sealing surface
25 First sealing surface
26 End position
27 Coding groove
28 Elastically deformable extension

What is claimed:

1. A socket for an electrical plug-in socket connection, comprising:

(a) a socket housing;

(b) a plug-in opening for mating with a plug:

(c) a contact support insert positioned in the socket housing; and (d) contacts extending into the plug-in opening, which are fixed in the contact support insert only by the material of the contact support insert, wherein the contact support insert having the fixed contacts is produced using an injection molding process, and the contact support insert is positioned into the socket housing such that the plug-in opening is sealed, and wherein a seal is provided in the socket housing which forms a sealing surface positioned in the plug-in opening to cooperate with the plug, and which can be moved towards the plug.

2. The socket of claim 1, where in the plug-in opening has an inner peripheral surface, and wherein the sealing surface is aligned approximately perpendicular to the inner peripheral surface, and preferably contacts the inner peripheral surface.

3. The socket of claim 1, wherein the seal is arranged, at least in sections, around the contact support insert for sealing against the socket housing.

4. The socket of claim 1, wherein the seal forms a second sealing surface with the contact support insert.

5. The socket of claim 1, wherein the seal is configured as a single component comprised of an elastic material.

6. The socket of claim 1, further comprising:

(a) a step in the socket housing, located at one end of the plug-in opening, on which the contact support insert is positioned; and (b) a fastening protrusion which extends into the plug-in opening of the socket housing, and which engages a groove in the seal.

7. The socket of claim 1, wherein the sealing surface can be adjusted toward the plug via an elastic force.

8. The socket of claim 7, wherein the seal has an elastically deformable section distinct from the sealing surface.

9. The socket of claim 8, wherein the elastically deformable section of the seal comprises V-shaped extensions that are adjustable in a bellows like fashion.

10. The socket of claim 8, wherein the seal comprises a spring element in the elastically deformable section.

11. The socket of claim 10, wherein the spring element is integrated into the seal.

12. A socket for an electrical plug-in socket connection, comprising:

(a) a socket housing;

(b) a plug-in opening for mating with a plug:

(c) a contact support insert positioned in the socket housing; and (d) contacts extending into the plug-in opening, which are fixed in the contact support insert only by the material of the contact support insert, wherein the contact support insert haying the fixed contacts is produced using an injection molding process, and the contact support insert is positioned into the socket housing such that the plug-in opening is sealed, and wherein a seal is provided in the socket housing which forms a sealing surface which cooperates with the socket housing.

13. The socket of claim 12, wherein the seal is arranged, at least in sections, around the contact support insert for sealing against the socket housing.

14. The socket of claim 12, wherein the seal forms a second sealing surface with the contact support insert.

15. The socket of claim 12, wherein the seal is configured as a single component comprised of an elastic material.

16. The socket of claim 12, further comprising:

(a) a step in the socket housing, located at one end of the plug-in opening, on which the contact support insert is positioned; and (b) a fastening protrusion which extends into the plug-in opening of the socket housing, and which engages a groove in the seal.

* * * * *